United States Patent [19]

Stern

[11] Patent Number: 5,018,263

[45] Date of Patent: May 28, 1991

[54] METHOD FOR MAKING A METAL SCREEN DOOR FRAME

[76] Inventor: Melvin J. Stern, 2126 Harbor Way, Ft. Lauderdale, Fla. 33326

[21] Appl. No.: 415,906

[22] Filed: Oct. 2, 1989

[51] Int. Cl.[5] ..... B21D 35/00

[52] U.S. Cl. ..... 29/469.5; 29/897.312; 49/425; 72/307; 160/371

[58] Field of Search ..... 29/469.5, 505, 527.1, 29/527.4, 557, 558, 897.31, 897.312, 897.3; 49/425, 501; 160/371, 381; 72/307, 294

[56] References Cited

U.S. PATENT DOCUMENTS

| | | | |
|---|---|---|---|
| 2,006,925 | 6/1949 | Klemp | 72/335 |
| 3,879,894 | 4/1975 | Anderson | 49/425 |
| 4,112,622 | 9/1978 | Stewart | 49/425 |
| 4,462,237 | 7/1984 | Kauferle | 72/307 |
| 4,503,640 | 3/1985 | Stern | 49/425 |
| 4,562,677 | 1/1986 | Hrabák | 29/897.31 |

*Primary Examiner*—Howard N. Goldberg
*Assistant Examiner*—D. Cuda
*Attorney, Agent, or Firm*—Duckworth, Allen, Dyer & Doppelt

[57] ABSTRACT

A one-piece sealed, hollow, steel sliding screen door frame and method of fabrication thereof is described. A flat steel strip is diecut to produce 45° miter cuts, each having an opposing flap. The cut strip is rolled to produce a frame stock having an essentially rectangular profile. Longitudinal edges of the strip are folded together, crimped and bonded during the rolling and form a screen channel in the frame stock. The frame stock is bent at right angles at the miter cuts such that the flaps tuck under the miter cuts, forming a rectangular door frame. Epoxy is used to bond the flaps to the inner surfaces adjacent the miter cuts. A screen door assembled using the door frame includes self-centering wheel assemblies.

7 Claims, 4 Drawing Sheets

METHOD FOR MAKING A METAL SCREEN DOOR FRAME

FIELD OF THE INVENTION

The present invention relates to screen doors, and more particularly to metal screen door frames, and methods for making such frames.

DESCRIPTION OF THE PRIOR ART

It is known in the prior art to construct a screen door frame, such as used as a sliding door for a patio door and the like, from a continuous length of formed metal. For example, a strip of sheet steel equal in length to the perimeter of the desired frame is rolled into a rectangular cross section stock and crimped at the free longitudinal edges, creating a closed cross sectional contour. Openings are then cut to form mitered corners and necessary holes drilled. The stock is then cut into jambs, head and sill with 45° miters. The 4 sections are then joined together with a friction clip to form a rectangle. The frame is unstable due to movement along the crimped edges, and the open edges of the butted miter corners. Friction corner clips are often required to stabilize the frame. Further, the process of drilling and punching holes after forming of the frame introduces manufacturing tolerance problems. Thus, such frames perform poorly for their intended use.

Wheels or rollers for such door frames commonly use an adjustable screw for coarse vertical adjustment and a coil spring for vertical play. This construction adds to manufacturing costs and the adjustments are subject to change with use.

There is a need for a one-piece metal screen door frame and manufacturing method that will economically provide a rigid, stable frame in which no mechanical wheel adjustment is required.

A unitized door frame and method is described in U.S. Pat. No. 4,503,640 formed from aluminum extrusions. Corner joints and metal door frames are disclosed in U.S. Pat. Nos. 2,619,574; 1,003,070; 4,125,925; 4,380,110 and 4,562,677. None of these references teach the method and door frame disclosed herein.

SUMMARY OF THE INVENTION

The present invention provides a one-piece metal door frame having a corner construction that gives the appearance of a 45° miter joint without the use of rivets, screws or other visible fasteners. The method of the invention includes the following steps.

A continuous strip of metal, preferably thin sheet steel is extended along a work surface. While the metal is still flat, die cuts are made at the location of each corner along the strip. One cut is, for example, a 45° miter cut and the mating cut is modified to provide a flap to be tucked under the miter cut during subsequent forming operations. Openings to be required through the frame for wheels, and lock handle holes are punched while the strip is flat. Advantageously, performing all cutting and punching operations while the metal strip is flat permits close tolerances to be maintained and the number of handling operations to be significantly reduced over prior art methods. Further, only one machine operator is necessary to conduct these operations.

Next, the strip is rolled through a plurality of roller steps to form an essentially rectangular profile cross section. One edge of the profile provides an overlap of the edges of the metal strip which is folded and crimped to form a channel for attachment of screening in the finished door frame. Prior to crimping in the roller steps, epoxy is deposited along the edges. Thus, when crimped, the profile is stabilized by the mechanical crimping and the adhesive epoxy.

The profile edge opposite the crimped edge is folded during rolling to form a channel therein to provide rigidity to the member. During the roll forming process, a bead of epoxy is applied to the inside of each 45° miter. This process is controlled by computer and fiber optic sensors that signal the epoxy guns to deposit the material at precisely the right time and place. Part II, the activator for the epoxy, is sprayed on the opposing flap at the end of the forming cycle. Thereafter, the frame stock is placed in a squaring fixture and each corner is formed by an air cylinder which tucks the flap under the miter edge. This operation can also be performed by a single individual manually folding the longitudinal section and placing it in the squaring fixture. When the epoxy cures, the two flaps at each corner will be securely bonded to the inside surface of the 45° cuts.

A wheel assembly for the door utilizes a vertically movable roller which is biased by a heavy spring, which may be on the order of fourteen pounds, for example. A pair of wheel assemblies is mounted in the sill portion and in the head portion of the frame. As will be recognized, when mounted in a jamb frame or the like, the spring will automatically center the door frame without the necessity of mechanical adjustment. Prime door frames are very often installed out of square. If adjustment screws are utilized, the screen may roll at the highest end of the parallelogram, and bind at the lowest. Self-adjusting wheels eliminate this problem.

The door lock handle is installed and the corners of the frame are rounded with an insert. At this point, the metal door frame is complete and ready for installation of screening.

As will now be recognized, a hollow, sealed metal door frame is provided by the method of the invention in which each corner is securely attaching, having a mitered appearance, and which includes self-centering wheels, eliminating adjustments. The number of steps and operations have been advantageously and drastically reduced, allowing a quality door to be manufactured at a low cost.

It is therefore a principal object of the invention to provide a method for fabricating a sealed, hollow screen door frame from sheet metal having mechanical stability, the door having wheels that automatically center the frame when installed.

It is another object of the invention to provide a metal screen door frame formed from a single strip of metal having the appearance of mitered corners, high mechanical stability and sealed which can be manufactured at low cost.

It is still another object of the invention to provide a low-cost method of forming a rigid, stable metal door frame from a strip of metal in which all cuts and openings are formed while the metal is flat to insure close tolerances and minimize the number of operations.

It is yet another object of the invention to provide a method of forming a metal door frame from a precut strip of metal utilizing a plurality of rolling operations that form an overlap of the longitudinal edges of the metal strip and that crimp the edges after application of epoxy thereto to bond the crimped seal from longitudinal movement.

It is another object of the invention to provide a novel mitered corner construction for a metal door frame in which a corner includes one miter cut and an opposing flap tucked under the cut and bonded to the underside with epoxy.

It is another object of the invention to produce a low-cost screen door using the methods described in previous paragraphs to provide the user with a reliable structure in a screen door that will eliminate the most common flaws in current art relative to screen doors, namely parallelograming and track jumping.

It is another object of the method of construction that this salient new art be made available to the inventor for use in other unrelated door structures, such as swinging screen doors and swinging storm doors where a low cost structurally superior door would be a feature needed in the market place.

These and other objects and advantages of the invention will become apparent from the following detailed description when read in conjunction with the drawings.

DETAILED DESCRIPTION OF THE PREFERRED EMBODIMENT

Figure 1:
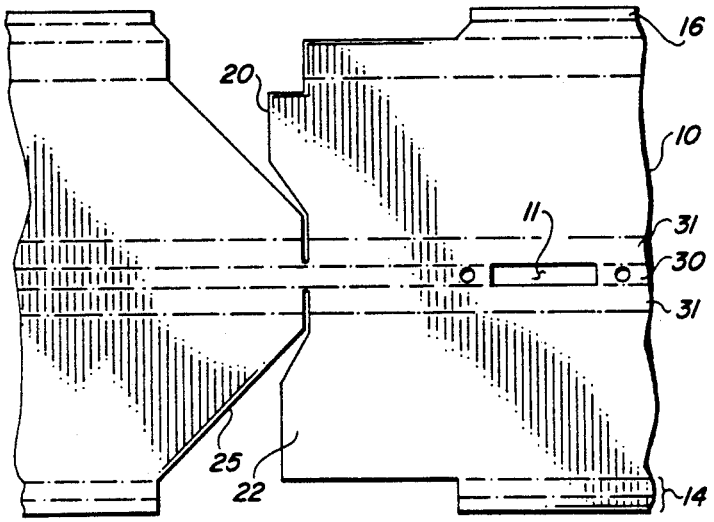
FIG. 1 is a partial plan view of the metal strip used to form the metal door frame of the invention showing the cuts for a corner of the frame.

The initial step in the method of the invention is the preparation of a strip of thin metal, such as steel, for cutting to form an essentially rectangular, hollow frame stock 12. Such stock may be formed in continuous lengths and cut to shorter lengths for a desired size door frame. As shown in FIG. 1, which shows metal strip 10 cut at a point along its length that a corner is to be formed. It is to be understood that such cuts are preferably diecut and will be made for the entire length of the strip 10. The spacing between adjacent cuts will be equal to the width and height of the frames, respectively. One cut 25 produces a 45° miter portion in both longitudinal edges, and cuts 22 and 20 define flaps which will be tucked under miter cut 25 in a succeeding step. Also shown in slot 11 with mounting holes for mounting a wheel assembly in the finished door frame. The metal strip will be folded in a succeeding step along the dot-dash lines, producing the desired essential rectangular cross section of the frame stock 12.

Figure 2:
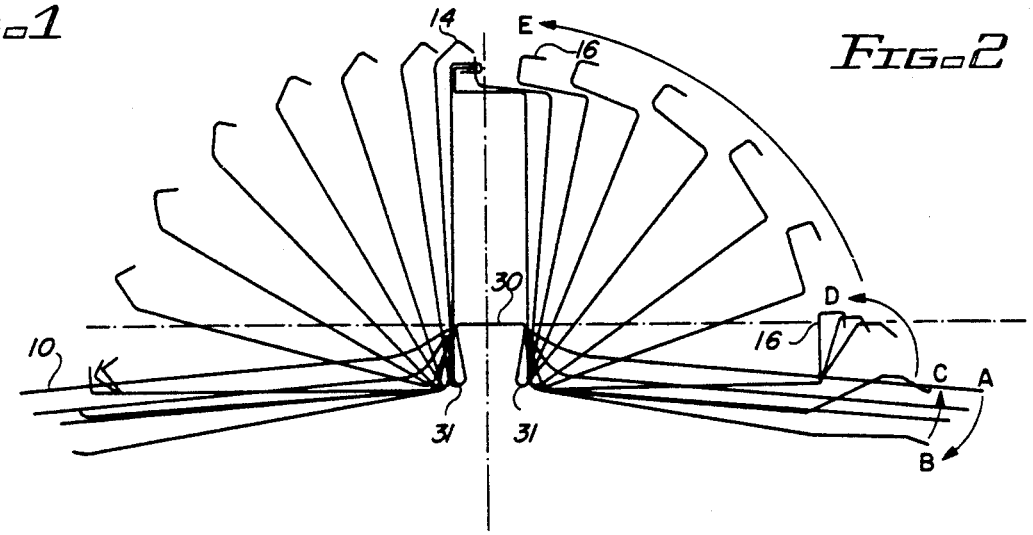
FIG. 2 is a "flower" pattern representation of the steps in rolling of the metal strip to form a hollow, door frame stock.

The folding of the cut metal strip 10 is accomplished by a plurality of rolling steps. FIG. 2 presents a "flower" diagram that indicates a typical number of rolling steps, and the shape of the strip after each step. The first roll produces the shape at A which results in the formation of side extensions 31 and surface 30. Three successive rolls produce shape B. Fold 16 and part of fold 14 are produced in next rolls B, C and D. The following rolls to roll E bring fold 16 and fold 14 together.

Figure 5:
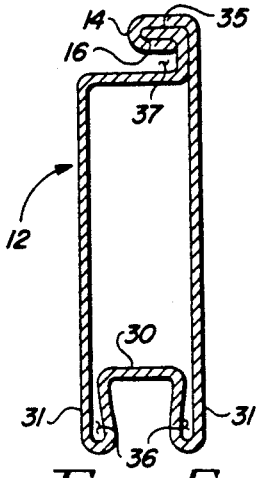
FIG. 5 is a cross-sectional view through the frame stock of FIG. 3 in the plane 5—5.
Figure 3:
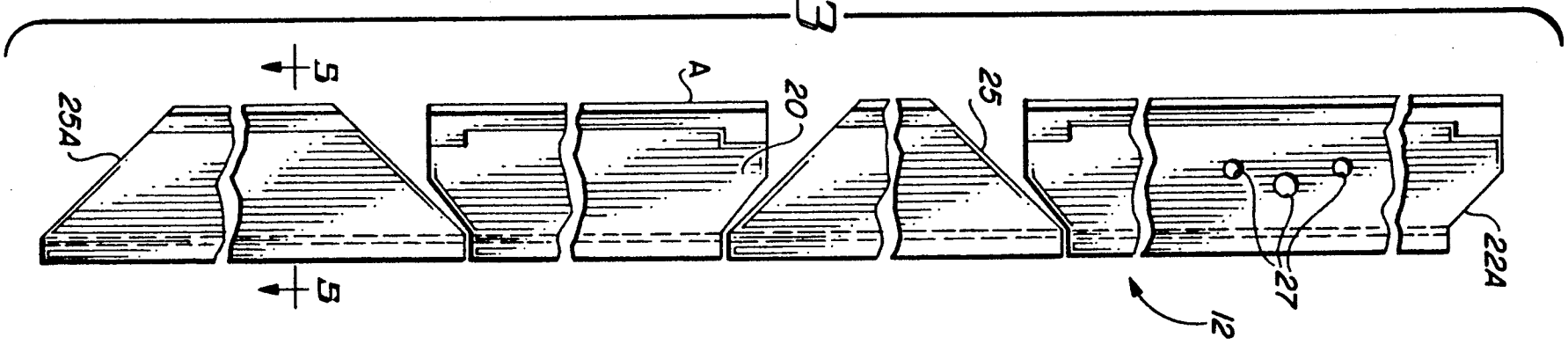
FIG. 3 is a side view of hollow door frame stock resulting from the rolling step of FIG. 2.

At this point, activated epoxy is applied to the inside surface of fold 14 which is then crimped over the edge of fold 16. Curing of the epoxy 33, shown in FIG. 5, securely bonds the longitudinal edges of strip 10 together to ensure stability of the frame stock. FIG. 3 is a side view of the frame stock 12 after completion of the rolling and crimping steps, having been cut to produce stock for one door frame. FIG. 5 is a cross-sectional view of stock 10 in the plane 5—5.

Figure 4:
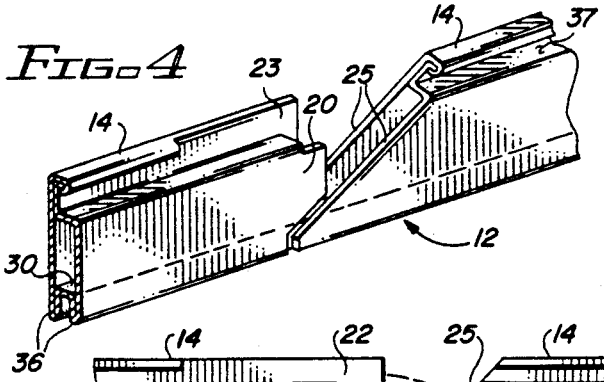
FIG. 4 is a partial perspective view of a corner area of the frame stock of FIG. 3.
Figure 6:
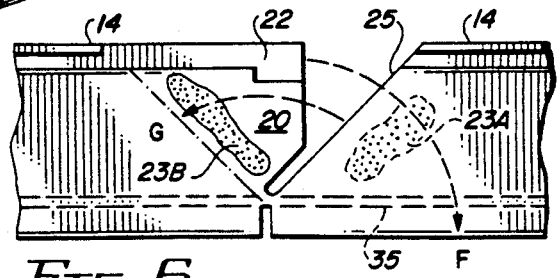
FIG. 6 is a side view of the corner area of FIG. 4 showing the folding step thereof.

Referring now to FIG. 4, a partial section of frame stock 12 is shown in a corner area. Fold 14 forms a channel 37 for screening and spline as will be shown hereinbelow. Flaps 23 and 20 are seen opposing 45° cuts 25. When a corner is bent, flaps 23 and 20 will be tucked under 45° cuts 25 such that the two folds 14 meet. The edges of flaps 23 and 20 will extend into side extensions 31. This operation is best seen in FIG. 6. Beads of inactivated epoxy 23A are spread on the inside surfaces of miter 25 and into space 36. An epoxy activator 35 is sprayed onto the outer surface of flaps 20 and 23. Frame stock 12 is placed in a squaring fixture and pneumatic rams operate to bend stock 12 at right angles at each corner cut with the edges of flaps 20 and 23 tucked to enter behind cut 25 and be forced into spaces 31 a shown by arrow F. The activator 35 causes epoxy 23A to bond while the surface epoxy 23B bonds to the inner surfaces of cut 25. The edges of cut 25 move as shown by arrow G to form a 45° miter appearance of a right angle corner.

Figure 7:
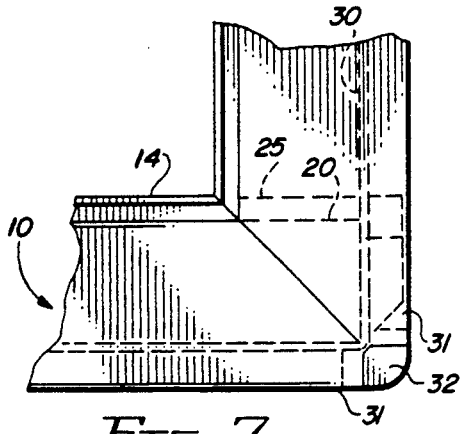
FIG. 7 is a view of the completed corner of FIG. 6.

FIG. 7 is a view of a corner after folding with the projection of flaps 20 and 23 into spaces 31 seen in phantom view. After the four corners are bent and joined, a rectangular metal door frame results from cut 25A of FIG. 3 joined with flap 20A. As shown in FIG. 7, the notched corners of bent stock 10 are filled with epoxy such that the entire door frame is sealed, thereby minimizing the possibility of water intrusion and rusting.

Figure 8:
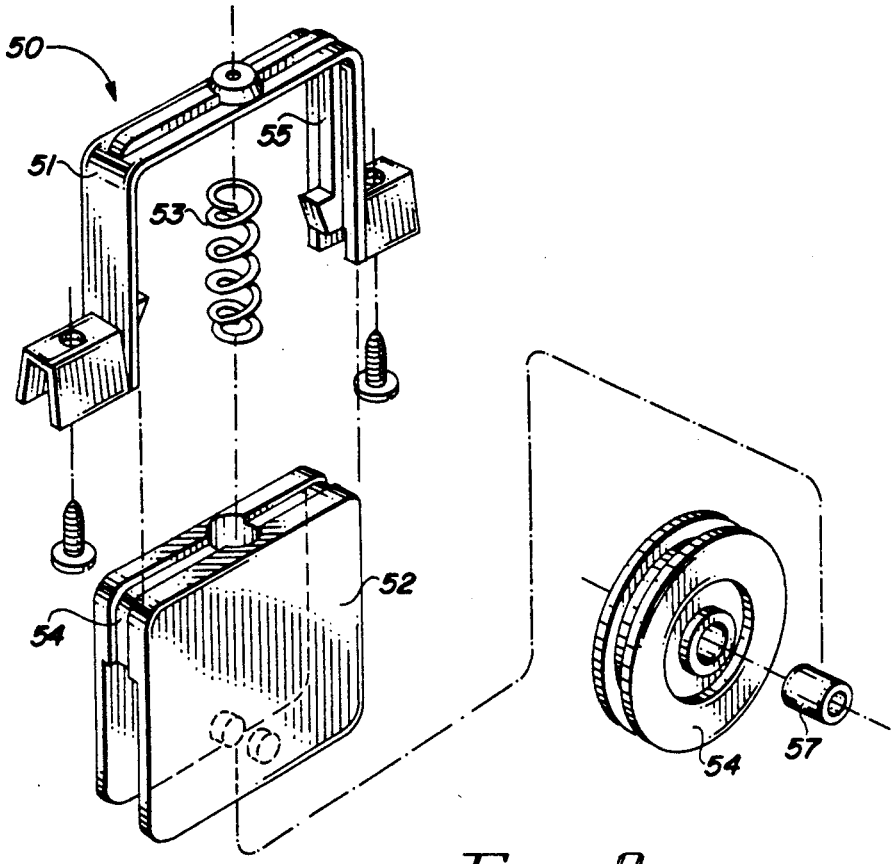
FIG. 8 is an exploded view of a wheel assembly for use with the door frame of the invention.

A wheel assembly 50, suitable for the door frame of the invention, is shown in exploded view in FIG. 8. A bracket 51 accepts a wheel carriage 52 having grooves 54 which ride on rails 55. A coil spring 53 tends to bias carriage 52 downward as shown. A wheel or roller 54 is mounted by bearing 57 in carriage 52. Spring 53 is selected to resist the weight of the complete screen door; for example, a fourteen-pound spring has been found suitable.

Figure 9:
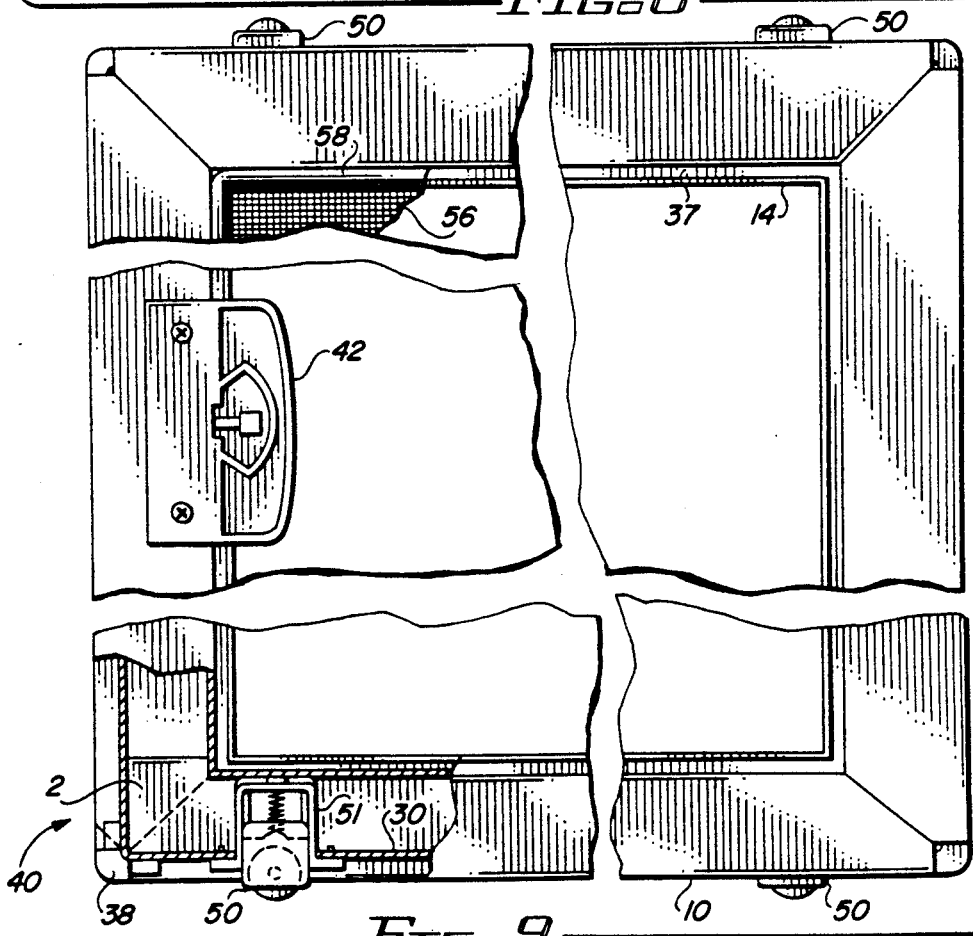
FIG. 9 is an elevation view of a typical metal door frame of the invention shown partially cut away.

FIG. 9 shows a completed screen door 40 in accordance with the invention with a lower corner thereof cut away to illustrate the wheel assembly 50 mounting. Wheel frame 51 is mounted through a slot 11 in surface 30 and wheel 54 projects a short distance below the lower edge of the door sill member. A second wheel assembly 50 is mounted at the right corner and a pair of wheel assemblies 50 in the head member. However, additional wheel assemblies may be used depending on the width of door 40. As will be apparent, springs 53 in the upper and lower frame members will serve to maintain the door centered in its jamb frame without the need for mechanical adjustment. A lock handle 42 is shown installed in holes 27 see in FIG. 3. Screening 56 is indicated installed in the door frame by a spline 58 pressed into channel 37 formed by seam 14.

Figure 10:
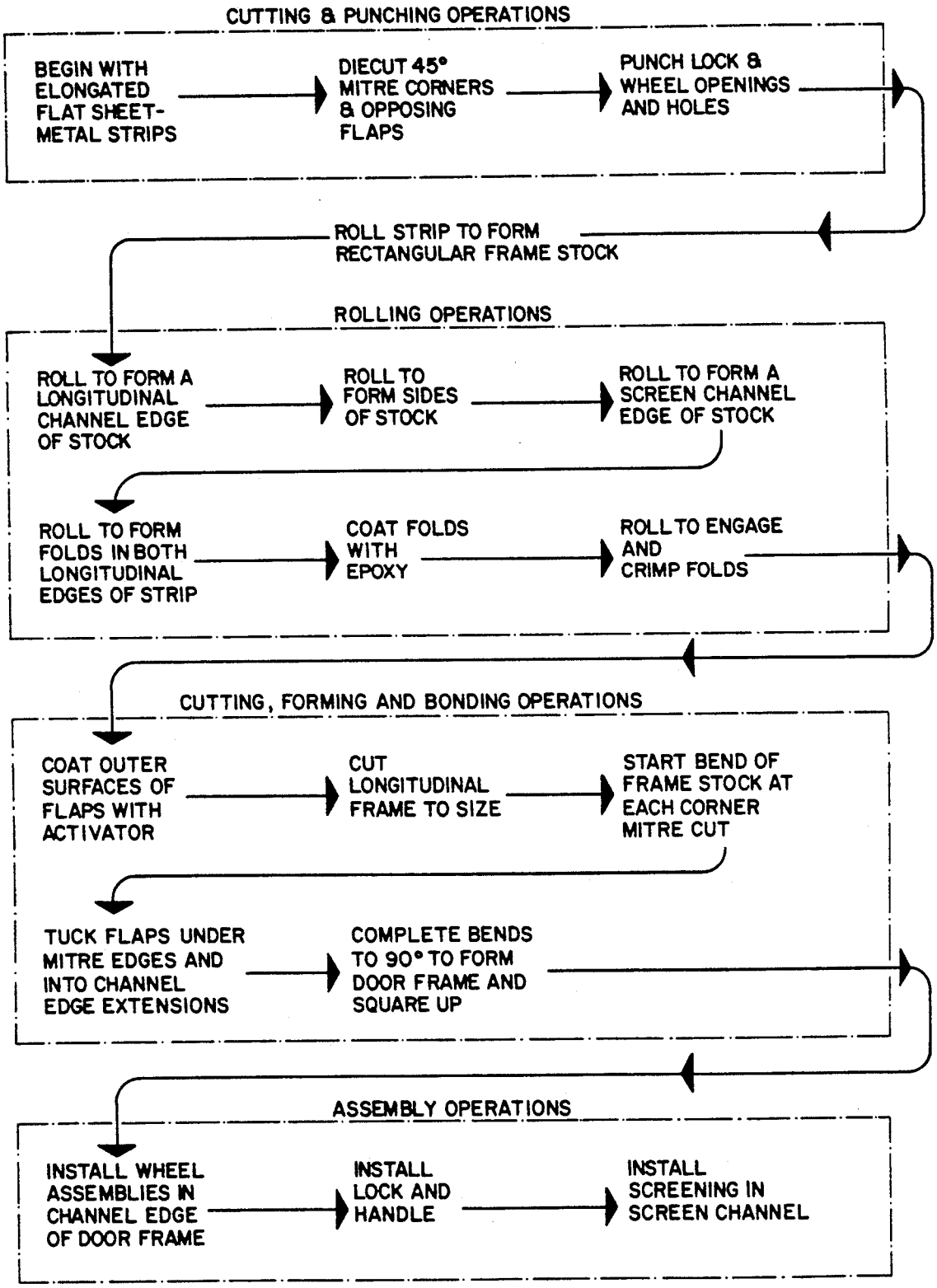
FIG. 10 is a flow diagram of the method of the invention.

The steps in forming frame stock 12 and door 40 are shown in FIG. 10.

As will now be recognized, a one-piece hollow steel door frame construction has been disclosed in which: all seams are bonded with epoxy to prevent movement of joints, thereby producing a rigid, stable door frame without requiring reinforcing braces or materials; the hollow frame is effectively sealed by epoxy to prevent moisture intrusion thereby extending the life of the frame; all cutting and punching required is performed on a flat metal strip prior to forming thereby reducing handling, and avoiding tolerance errors; and forming of the frame profile is performed automatically by a sequence of rolling operations, thereby minimizing labor and assuring uniform profiles.

Roll formed doors now constructed from four individual pieces of a rectangular section mitered at 45° and machined after rolling, are assembled with some type of friction corner clip. This type of construction, not being rigid, tends to become a parallelogram in use and causes malfunction or jumps the track. The present invention features a construction using rigid corners and, by adding epoxy between the crimp closure, the provision for a true hollow section, rather than a pseudo hollow which permits racking, as a friction crimp cannot incorporate the structural qualities needed to maintain an absolutely square and rigid structure.

Although the method and door frame of the invention have been described with reference to specific examples, such examples may be modified without departing from the spirit and scope of the invention. Although sheet steel is preferred for the frame, aluminum and other metals may be substituted. Thus, the invention is to be limited only by the claims.

I claim:

1. A method of forming a hollow metal door frame comprising the steps of:

a) cutting an elongated continuous flat sheet metal strip;

b) cutting angled miter corners and opposing flaps in longitudinal edges of the strip;

c) rolling the strip to form an essentially rectangular frame stock including crimping and bonding free longitudinal edges of the strip;

d) coating a surface of the miter and flaps with an adhesive; and e) bending the frame stock to a right angle at each miter corner including tucking the flaps under the angled miter cuts to therefor form a rectangular door frame.

2. The method as defined in claim 1 in which steps a) through c) produce an essentially rectangular frame stock of indeterminate length having a plurality of groups of four of the cuts of step b), including the additional step of cutting the frame stock to lengths each having one group of four miter cuts.

3. The method as defined in claim 1 in which the sheet metal is steel.

4. The method as defined in claim 1 in which the bonding of step c) includes bonding with epoxy.

5. The method as defined in claim 4 in which step c) includes the steps of:

f) rolling the strip to form a longitudinal channel edge of the frame stock, the channel formed by folding of the strip to form channel edge extensions;

g) rolling the strip to form a screen channel edge portion of the stock;

h) rolling free longitudinal edges of the strip to form folds in each edge;

i) coating the folds with epoxy; and j) rolling the strip to engage and crimp the folds, the crimped edges forming a screen channel with the screen channel portion of the stock.

6. The method as defined in claim 5 in which steps d) and e) include the steps of:

k) coating the edge inner surfaces of the miter cuts and channel edge with an inactivated epoxy;

l) injecting epoxy activator onto flaps in the channel edge extensions; and m) bending the frame stock to force the edges of the flaps into the channel edge extensions thereby activating the epoxy.

7. The method as defined in claim 5 including the further steps of:

n) installing wheel assemblies in sill members and in head members of the rectangular door frame;

o) installing a lock handle in a jamb member of the door frame; and p) installing screening in the screen channel.

* * * * *